US007664270B2

(12) United States Patent
Lee et al.

(10) Patent No.: US 7,664,270 B2
(45) Date of Patent: Feb. 16, 2010

(54) 3D AUDIO SIGNAL PROCESSING SYSTEM USING RIGID SPHERE AND METHOD THEREOF

(75) Inventors: Tae-Jin Lee, Daejon (KR); Dae-Young Jang, Daejon (KR); Kyeongok Kang, Daejon (KR); Chieteuk Ahn, Daejon (KR); Jin-Woong Kim, Daejon (KR); Hareo Hamada, Tokyo (JP); Toshio Saito, Tokyo (JP)

(73) Assignees: Electronics and Telecommunications Research Institute (KR); Dimagic Co., Ltd., Tokyo (JP)

( * ) Notice: Subject to any disclaimer, the term of this patent is extended or adjusted under 35 U.S.C. 154(b) by 824 days.

(21) Appl. No.: 10/972,029

(22) Filed: Oct. 22, 2004

(65) Prior Publication Data

US 2005/0141723 A1 Jun. 30, 2005

(30) Foreign Application Priority Data

Dec. 29, 2003 (KR) ..... 10-2003-0099168
Apr. 20, 2004 (KR) ..... 10-2004-0027214

(51) Int. Cl.
*H04R 5/00* (2006.01)

(52) U.S. Cl. ..... 381/1; 381/17; 381/307

(58) Field of Classification Search ..... 381/1–28, 381/300, 303–309, 122, 92
See application file for complete search history.

(56) References Cited

U.S. PATENT DOCUMENTS 4,393,270 A 7/1983 van den Berg
5,862,227 A * 1/1999 Orduna-Bustamante et al. ..... 381/17
6,005,948 A * 12/1999 Maeda ..... 381/18
6,041,127 A 3/2000 Elko (Continued)

FOREIGN PATENT DOCUMENTS

JP 51/085702 7/1976

(Continued)

OTHER PUBLICATIONS

Kahana et al Title: A Multiple Microphone Recording Technique for the Generation of Virtual Acoustic Images J Acoustic. Soc. Am. 105 Mar. 1999.*

(Continued)

*Primary Examiner*—Vivian Chin
*Assistant Examiner*—Fatimat O Olaniran
(74) *Attorney, Agent, or Firm*—Blakely, Sokoloff, Taylor & Zafman

(57) ABSTRACT

Provided are a three-dimensional audio signal processing system using a rigid sphere and a method thereof. The three-dimensional audio signal processing system of the present research simplifies the shape of a human head into a rigid sphere, acquires three-dimensional audio signals by setting up mikes on the rigid sphere, and applies the acquire three-dimensional audio signals to diverse existing reproduction systems. The system includes a three-dimensional audio signal acquiring unit for acquiring audio signals by using a predetermined number of mikes set up on the rigid sphere; and a three-dimensional audio signal post-processing unit for converting the acquired audio signals to reproduce in diverse reproduction environments such as five-channel, four-channel, headphone, stereo, and stereo dipole reproduction environments.

11 Claims, 8 Drawing Sheets

U.S. PATENT DOCUMENTS

| | | | | |
|---|---|---|---|---|
| 6,424,719 | B1 * | 7/2002 | Elko et al. | 381/1 |
| 6,904,152 | B1 * | 6/2005 | Moorer | 381/18 |
| 6,934,395 | B2 * | 8/2005 | Ito | 381/23 |
| 2003/0147539 | A1 | 8/2003 | Elko et al. | |

FOREIGN PATENT DOCUMENTS

| | | |
|---|---|---|
| JP | 03/125599 | 5/1991 |
| JP | 08-107595 | 4/1996 |
| JP | 2000-023300 | 1/2000 |
| JP | 2000-152372 | 5/2000 |
| JP | 2000-354300 | 12/2000 |
| JP | 2004-204600 | 7/2003 |
| WO | WO01/31973 | 5/2001 |

OTHER PUBLICATIONS

Kahana et al Title: A Multiple Microphone Recording Technique for the Generation of Virtual Acoustic Images J Acoustic. Soc. Am. 105 Mar. 199.*

Kirkeby et al Title: Local sound field reproduction using digital signal processing J Acoustic. Soc. Am. 100 Sep. 1996.*

Kahana et al Title: A Multiple Microphone Recording Technique for the Generation of Virtual Acoustic Images J. Acoustic Soc. Am. 105 Mar. 1999.*

Yuvi Kahana et al., "A multiple microphone recording technique for the generation of virtual acoustic images," Acoustical Society of America, pp. 150-3-1596, 1999.

Japanese Office Action, Jun. 2, 2009, Patent Application No. 2004-306832.

* cited by examiner

3D AUDIO SIGNAL PROCESSING SYSTEM USING RIGID SPHERE AND METHOD THEREOF

FIELD OF THE INVENTION

The present invention relates to a three-dimensional audio signal processing system using a rigid sphere, the method which can acquire three-dimensional audio signals by using mikes disposed on a rigid sphere and reproduce the three-dimensional audio signals in diverse reproduction environments.

DESCRIPTION OF RELATED ART

Conventionally, three-dimensional audio signal acquiring systems are mainly based on Binaural technology in which audio signals are acquired by setting up mikes on the ears of dummy heads and reproduced through a headphone.

Since the audio signals are acquired through the mikes set up in the ears of the dummy heads in the Binaural technology, when people listen to the audio signals through the headphone, it feels like that they are in the place where the sound is acquired.

However, if binaural signals are acquired through the dummy heads and reproduced in a speaker, crosstalk phenomenon occurs. Crosstalk is a phenomenon in which output signals of the left speaker are heard by the right ear while those of the right speaker are heard by the left ear. To remove the crosstalk phenomenon, various methods for designing an inverse filter are suggested.

Recently, researchers are studying a system with a rigid sphere, a simplified form of a dummy head that resembles the head of a human, to acquire three-dimensional audio signals through the rigid sphere. Since a rigid sphere can estimate the shape of a signal characteristically, the technology can give the effect of dummy head by acquiring and processing three-dimensional audio signals.

The conventional method of acquiring three-dimensional audio signals by using dummy heads can acquire very natural sound because it uses a dummy head, which resembles the head of a human. However, since the size and shape of a human head differ according to each individual, the audio signals obtained by using the dummy head having a specific size and shape in the conventional method cannot be satisfactory to all people.

Also, in the conventional method, when the binaural signals are reproduced through a speaker, the audio signals acquired by setting up mikes in the ears of the dummy heads travel through the ears of a listener. Thus, the effect of ears imposed on the signals is doubled.

In addition, the conventional dummy heads have a problem that it takes many restrictions to record sound in public places due to the size and shape of the dummy head which resembles the head of a human.

A human being moves his/her head a little to the right and left when he/she determines a direction of sound. However, the signals acquired from the dummy heads have an effect of front-back confusion, in which signals from the front direction are determined as signals from the back direction and the signals from the back are determined as the signals from the front. This is because it is hard to determine a direction due to the fixed direction of the ears of the dummy heads.

Moreover, since the output of a dummy head is basically a two-channel signal, it is hard to extend the output into a multichannel signal.

SUMMARY OF THE INVENTION

It is, therefore, an object of the present invention to provide a three-dimensional audio signal processing system and method using a rigid sphere, the system and method that can acquire three-dimensional audio signals by simplifying the shape of a human head into a sphere and disposing mikes on the sphere.

It is another object of the present invention to provide a three-dimensional audio signal processing system and method using a rigid sphere, the system and method that can acquire three-dimensional audio signals by simplifying the shape of a human head into a sphere and disposing mikes on the sphere and applying the acquired three-dimensional audio signals to diverse reproduction systems that exist currently.

In accordance with an aspect of the present invention, there is provided a system for processing three-dimensional audio signals by using a rigid sphere, including: a three-dimensional audio signal acquiring unit for acquiring audio signals by using a predetermined number of mikes set up on the rigid sphere; and a three-dimensional audio signal post-processing unit for converting the acquired audio signals to reproduce in diverse reproduction environments such as five-channel, four-channel, headphone, stereo, and stereo dipole reproduction environments.

In accordance with another aspect of the present invention, there is provided a three-dimensional audio signal processing system, further including a three-dimensional audio signal reproducing unit for reproducing the audio signals obtained from the three-dimensional audio signal post-processing unit in diverse reproduction environments such as five-channel, four-channel, headphone, stereo, and stereo dipole reproduction environments.

In accordance with another aspect of the present invention, there is provided a method for processing three-dimensional audio signals by using a rigid sphere, including the steps of: a) acquiring audio signals by using a predetermined number of mikes set up on the rigid sphere; and b) converting the audio signals to reproduce in diverse reproduction environments such as five-channel, four-channel, headphone, stereo, and stereo dipole reproduction environments.

In accordance with another aspect of the present invention, there is provided a three-dimensional audio signal processing method, further including a step of: c) reproducing the audio signals obtained from the three-dimensional audio signal post-processing unit in diverse reproduction environments such as five-channel, four-channel, headphone, stereo, and stereo dipole reproduction environments.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 1:
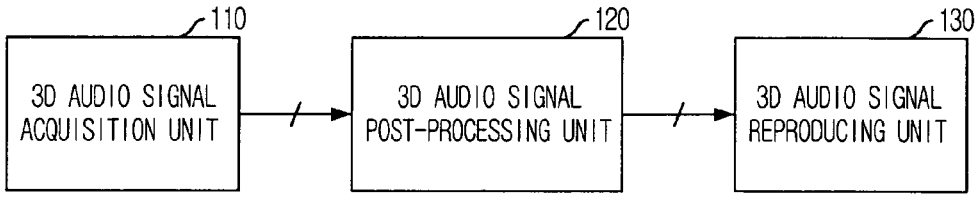
FIG. 1 is a block diagram showing a three-dimensional audio signal processing system using a rigid sphere in accordance with an embodiment of the present invention.

FIG. 1 is a block diagram showing a three-dimensional audio signal processing system using a rigid sphere in accordance with an embodiment of the present invention.

First, a conventional three-dimensional audio signal acquiring method using mikes set up at both right and left 90° positions can give a three-dimensional audio effect, because the technology can describe an interaural level difference and an interaural time difference between two ears which a human being uses to sense the direction of sound. However, due to the characteristics of a rigid sphere, signals that enter from the back and front at the same angle have the same characteristics. This causes front and back confusion in which signals from the front and those from the back are not discriminated from each other.

The present invention suggests a system and method that can reduce the front and back confusion by disposing a plurality of mikes on a rigid sphere and thereby differentiating the front and back signals and, additionally, reproduce the signals acquired from the mikes in diverse reproduction environments such as five-channel, four-channel, headphone, stereo, and stereo dipole reproduction environments.

As shown in FIG. 1, the three-dimensional audio signal processing system of the present invention includes a three-dimensional audio signal acquiring unit 110 and a three-dimensional audio signal post-processing unit 120. The three-dimensional audio signal acquiring unit 110 acquires audio signals by using a plurality of mikes, for example, five mikes, disposed on a rigid sphere. The three-dimensional audio signal post-processing unit 120 adapts the audio signals acquired in the three-dimensional audio signal acquiring unit 110 to diverse reproduction environments such as five-channel, four-channel, headphone, stereo, and stereo dipole reproduction environments. It further includes a three-dimensional audio signal reproducing unit 130 for reproducing the audio signals obtained in the three-dimensional audio signal post-processing unit 120 in diverse reproduction environments such as five-channel, four-channel, headphone, stereo, and stereo dipole reproduction environments.

The three-dimensional audio signal acquiring unit 110 acquires three-dimensional audio signals from the mikes disposed on the rigid sphere, a simplified form of a human head, and it includes a center mike for increasing the image of the front side and two side mikes on each right side and left side to compensate the head movement of the human.

The three-dimensional audio signal post-processing unit 120 performs post-processing to reproduce the three-dimensional audio signals, which are acquired in the three-dimensional audio signal acquiring unit 110 by using the five mikes on the rigid sphere, in diverse reproduction environments. The post-processing includes a 5×5 crosstalk removal filtering, a 4×4 crosstalk removal filtering, a conversion filtering and a 2×2 crosstalk removal filtering. The 5×5 crosstalk removal filtering is a process for reproducing the three-dimensional audio signals by using five channels except a low frequency effect (LFE) channel in a conventional 5.1 channel reproducing system.

The 4×4 crosstalk removal filtering is a process for reproducing the three-dimensional audio signals through a right speaker, a left speaker, a right surround speaker and a left surround speaker by using four channels except the center channel among the five channels.

The conversion filtering is a process for converting multi-channel signals into two-channel signals to reproduce them in a headphone. The 2×2 crosstalk removal filtering is a process for reproducing the two-channel signals for the headphone reproduction in stereo and/or stereo dipole reproduction environments.

The three-dimensional audio signal reproducing unit 130 reproduces the three-dimensional audio signals in diverse reproduction environments such as five-channel, four-channel, headphone, stereo, and stereo dipole reproduction environments by converting them in the three-dimensional audio signal post-processing unit 120 adaptively to a reproduction environment.

The three-dimensional audio signal processing system of the present invention will be described in detail with reference to FIGS. 2 to 10E.

Figure 2:
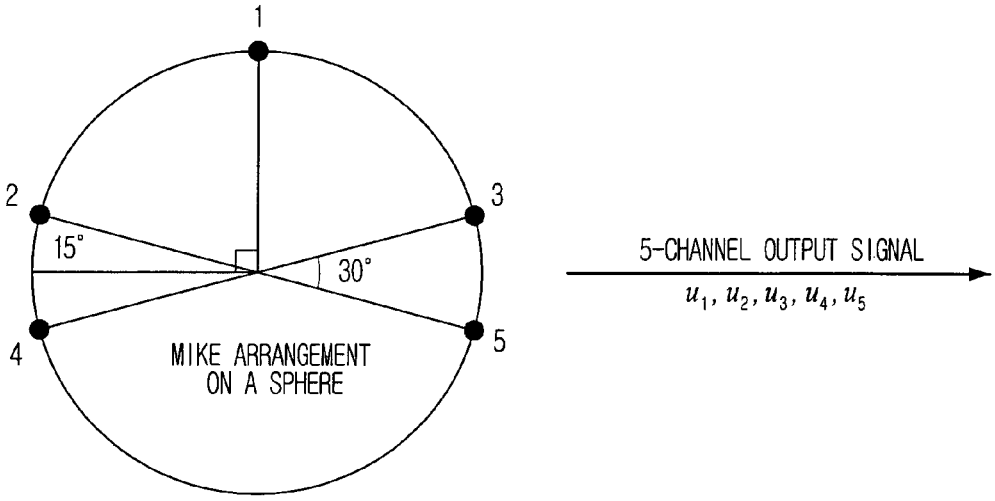
FIG. 2 is a diagram describing mike arrangement of a three-dimensional audio signal processing system in accordance with an embodiment of the present invention.

FIG. 2 is a diagram describing mike arrangement of a three-dimensional audio signal processing system in accordance with an embodiment of the present invention.

As shown in FIG. 2, audio signals are acquired in the three-dimensional audio signal acquiring unit 110 by disposing five mikes on the horizontal plane of the rigid sphere.

A mike is positioned at the center of the rigid sphere and acquires audio signals in front. Four side mikes are disposed on the right and left sides, two on each side at a degree of 15 before and behind in order to compensate the right/left head movement of a human, an action for determining the direction of sound.

The mike for the front side is referred to herein as a first mike and the mikes on the left are referred to as a second mike and a fourth mike. The mikes on the right are referred to as a third mike and a fifth mike. Audio signals acquired by using the five mikes are referred to as audio signals $u_1$, $u_2$, $u_3$, $u_4$, and $u_5$.

The three-dimensional audio signal post-processing unit 120 performs post-processing to reproduce the signals $u_1$, $u_2$, $u_3$, $u_4$, and $u_5$ outputted from the five mikes in the three-dimensional audio signal acquiring unit 110 in diverse reproduction systems.

Figure 3:
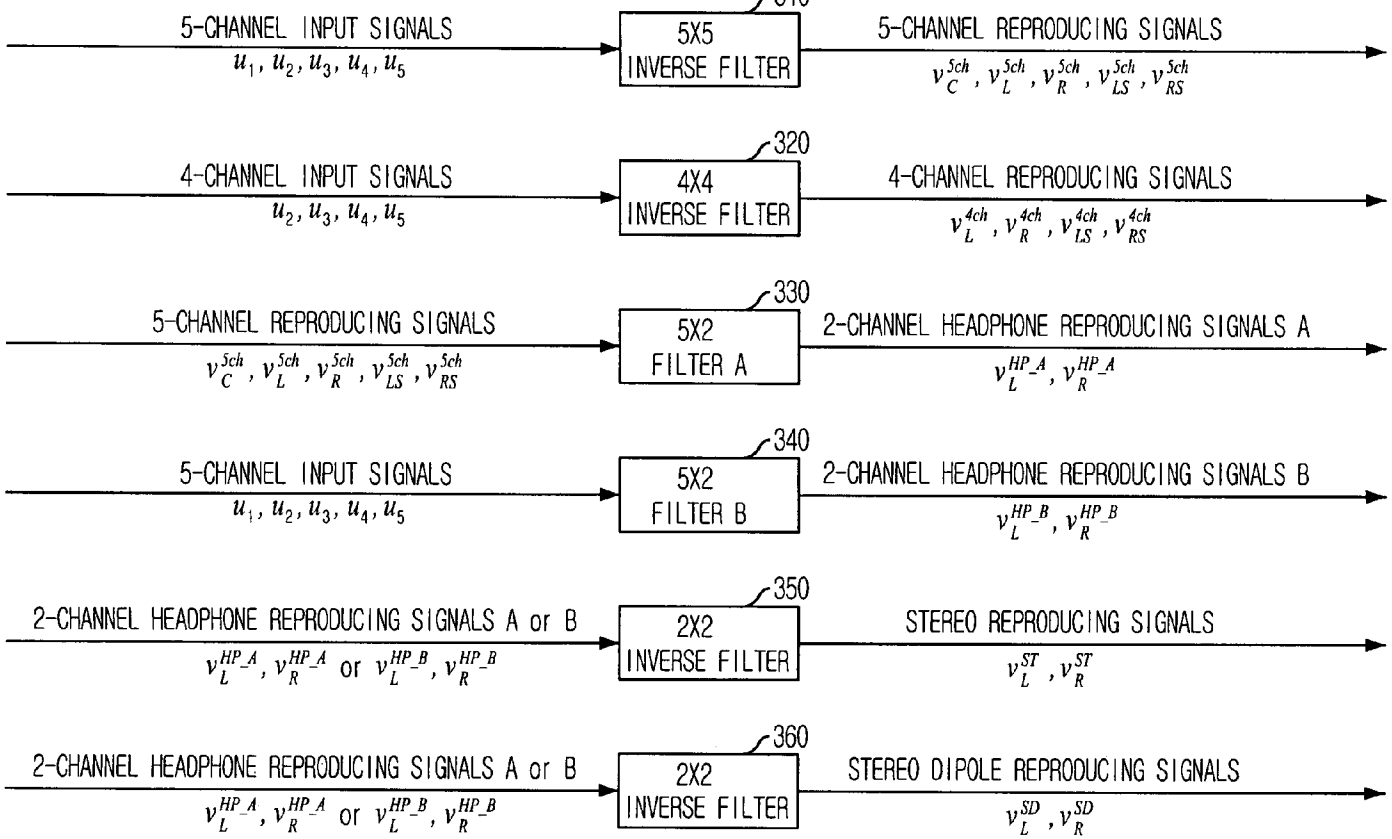
FIG. 3 is a diagram describing a three-dimensional audio signal post-processing unit of the three-dimensional audio signal processing system in accordance with an embodiment of the present invention.

FIG. 3 is a diagram describing a three-dimensional audio signal post-processing unit of the three-dimensional audio signal processing system in accordance with an embodiment of the present invention.

The three-dimensional audio signal post-processing unit 120 is operated as follows.

First, speaker input signals $v_C^{5ch}$, $v_L^{5ch}$, $v_R^{5ch}$, $v_{LS}^{5ch}$ and $v_{RS}^{5ch}$ of a five-channel reproduction system are generated based on the output signals $u_1$, $u_2$, $u_3$, $u_4$, and $u_5$ and the convolution operation in a 5×5 inverse filter 310 for removing crosstalk between five speakers and five target points. Here, $v_C^{5ch}$ denotes an input signal to a center speaker; $v_L^{5ch}$ denotes an input signal to a left speaker; $v_R^{5ch}$ denotes an input signal to a right speaker; $v_{LS}^{5ch}$ denotes an input signal to a left surround speaker; and $v_{RS}^{5ch}$ denotes an input signal to a right surround speaker.

Figure 4:
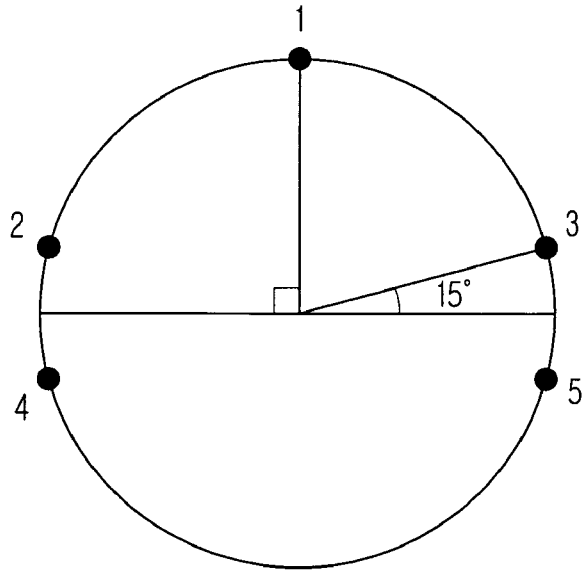
FIG. 4 is a diagram illustrating targets on a rigid sphere in the three-dimensional audio signal processing system when five channels are reproduced in accordance with an embodiment of the present invention.

Five target points indicate five points on a horizontal plane of the rigid sphere, which is illustrated in FIG. 4.

FIG. 4 is a diagram illustrating targets on the rigid sphere in the three-dimensional audio signal processing system when five channels are reproduced in accordance with an embodiment of the present invention.

In case of five-channel reproduction, an inverse filter is used to remove crosstalk between the speakers and target points so that the output signal of the center speaker is observed only in the first target point; that of the left speaker, only in the second target point; that of the right speaker, only in the third target point; that of the left surround speaker, only in the fourth target point; and that of the right surround speaker, only in the fifth target point.

To design the 5×5 inverse filter, five speakers are positioned with a rigid sphere at the center and impulse is generated from each of the five speakers. Then, an impulse response between the five speakers and five target points is obtained by measuring responses at the five target points on the rigid sphere.

The inverse function of the impulse response is the 5×5 inverse filter that removes crosstalk between the five-channel reproduction system and five target points.

The speaker input signals $v_C^{5ch}$, $v_L^{5ch}$, $v_R^{5ch}$, $v_{LS}^{5ch}$ and $v_{RS}^{5ch}$ the five-channel reproduction system are generated based on convolution operation of the output signals $u_1$, $u_2$, $u_3$, $u_4$, and $u_5$ in the three-dimensional audio signal acquiring unit 110.

Meanwhile, in order to generate four-channel reproducing signals, four speaker input signals are generated in 4×4 inverse filter 320 based on four mike output signals $u_2$, $u_3$, $u_4$, and $u_5$ except the first mike output signal $u_1$ among the five output signals $u_1$, $u_2$, $u_3$, $u_4$, and $u_5$ of the three-dimensional audio signal acquiring unit 110 except Low Frequency Effect (LFE) channel and the center channel among the structure of 5.1 channel speakers.

The speaker input signals $v_L^{4ch}$, $v_R^{4ch}$, $v_{LS}^{4ch}$ and $v_{RS}^{4ch}$ four-channel reproduction system are generated based on the output signals $u_2$, $u_3$, $u_4$, and $u_5$ of the three-dimensional audio signal acquiring unit 110 and a convolution operation of a 4×4 inverse filter for removing crosstalk between four speakers and four target points. Here, $v_L^{4ch}$ denotes an input signal of a left speaker; $v_R^{4ch}$ denotes an input signal of a right speaker; $v_{LS}^{4ch}$ denotes an input signal of a left surround speaker; and $v_{RS}^{4ch}$ denotes an input signal of a right surround speaker.

Figure 5:
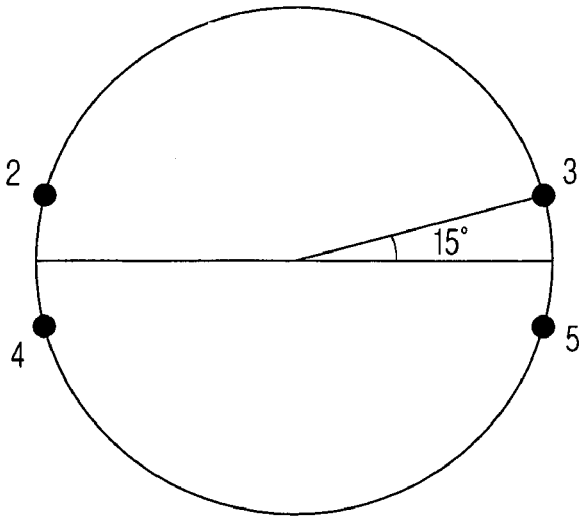
FIG. 5 is a diagram illustrating targets on a rigid sphere in the three-dimensional audio signal processing system when four channels are reproduced in accordance with an embodiment of the present invention.

The four target points denote four points on a horizontal plane of the rigid sphere, as shown in FIG. 5.

FIG. 5 is a diagram illustrating targets on the rigid sphere in the three-dimensional audio signal processing system when four channels are reproduced in accordance with an embodiment of the present invention.

In case of a four-channel reproduction, an inverse filter is used to remove crosstalk between the speakers and target points so that the output signal of the left speaker is observed only in the second target point; that of the right speaker, only in the third target point; that of the left surround speaker, only in the fourth target point; and that of the right surround speaker, only in the fifth target point.

The 4×4 inverse filter is designed by disposing four speakers with the rigid sphere at the center and generating impulses in the four speakers. Then, an impulse response between the four speakers and four target points is obtained by measuring the responses at the four target points on the rigid sphere.

The inverse function of the impulse response is the 4×4 inverse filter that removes crosstalk between the four-channel reproduction system and four target points.

The speaker input signals $v_L^{4ch}$, $v_R^{4ch}$, $v_{LS}^{4ch}$ and $v_{RS}^{4ch}$ of the four-channel reproduction system are generated based on convolution operation of the output signals $u_2$, $u_3$, $u_4$, and $u_5$ in the three-dimensional audio signal acquiring unit 110.

Meanwhile, headphone reproducing signals are generated in two methods which will be described hereafter.

Figure 6:
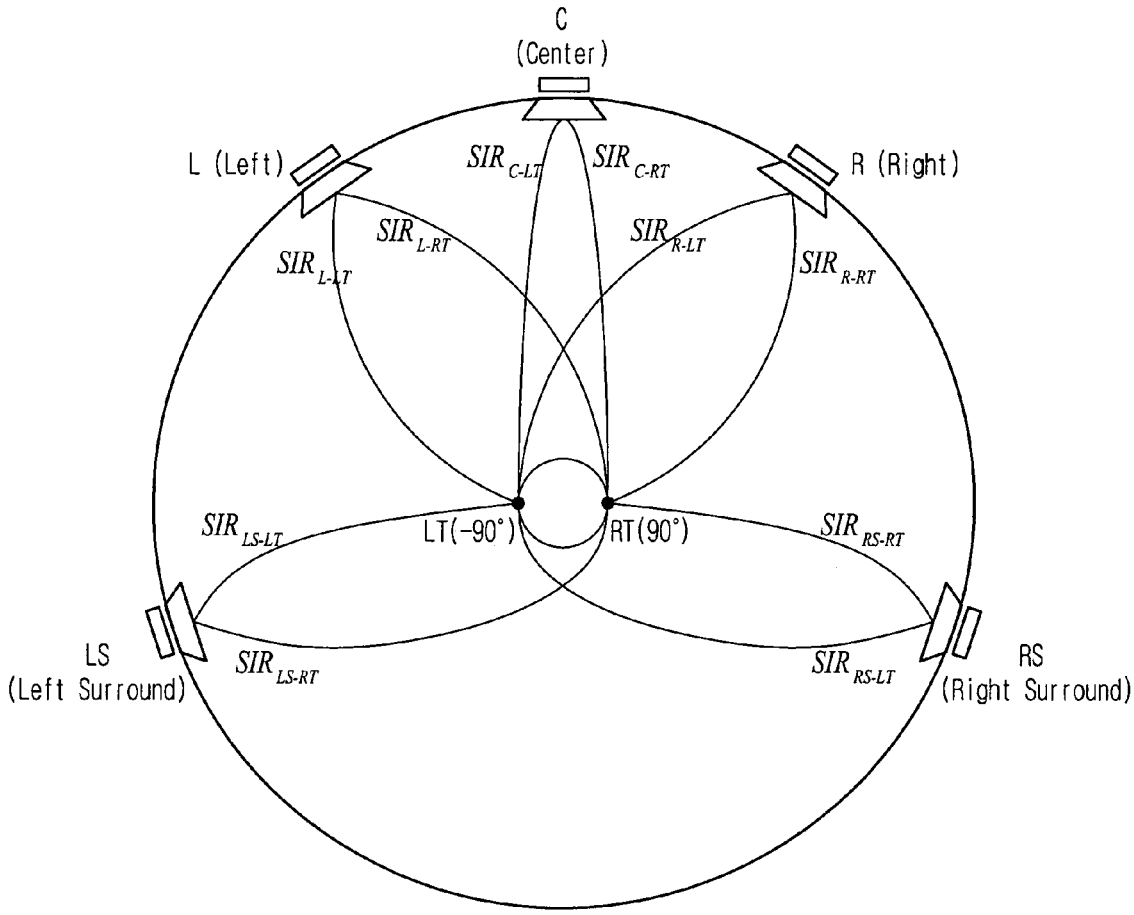
FIG. 6 is a diagram describing a rigid sphere and speakers for generating a headphone reproducing signal in the three-dimensional audio signal processing system in accordance with an embodiment of the present invention.

One method is to put the rigid sphere at the center of the five-channel reproduction system and convert five-channel speaker input signals into two-channel headphone reproducing signals in the 5×2 filter A 330 by using impulse responses from the positions of the five speakers and the right and left 90° positions of the rigid sphere, which is described in FIG. 6.

FIG. 6 is a diagram describing a rigid sphere and speakers for generating a headphone reproducing signal in the three-dimensional audio signal processing system in accordance with an embodiment of the present invention.

In the drawing, SIR denotes an impulse response of the rigid sphere, i.e., sphere impulse response; LT denotes the left 90° point of the rigid sphere; and RT denotes the right 90° point of the rigid sphere. That is, $SIR_{C\text{-}LT}$ denotes an impulse response from a center speaker to the LT.

After transfer functions from the five speakers to RT and LT at the right and left 90° positions of the rigid sphere at the center are obtained, right and left headphone reproducing signals $v_L^{HP_A}$ and $v_R^{HP_A}$ are generated based on the transfer functions and the signals $v_C^{5ch}$, $v_L^{5ch}$, $v_R^{5ch}$, $v_{LS}^{5ch}$ and $v_{RS}^{5ch}$ for five-channel reproduction by using convolution operation expressed as Equation 1 below. Here, $v_L^{HP_A}$ denotes a left headphone signal; $v_R^{HP_A}$ denotes a right headphone signal; and conv denotes convolution operation.

$$v_L^{HI'_A} = conv(v_C^{5ch}, SIR_{C-LT}) + conv(v_L^{5ch}, SIR_{L-LT}) + conv(v_R^{5ch}, SIR_{R-LT}) + conv(v_{LS}^{5ch}, SIR_{LS-LT}) + conv(v_{RS}^{5ch}, SIR_{RS-LT}) \quad \text{Eq. 1}$$

$$v_R^{HI'_A} = conv(v_C^{5ch}, SIR_{C-RT}) + conv(v_L^{5ch}, SIR_{L-RT}) + conv(v_R^{5ch}, SIR_{R-RT}) + conv(v_{LS}^{5ch}, SIR_{LS-RT}) + conv(v_{RS}^{5ch}, SIR_{RS-RT})$$

Subsequently, the other method for generating two-channel signals for headphone reproduction is to use a 5×2 filter B 340 obtained by converting an impulse response of the rigid sphere.

Figure 7:
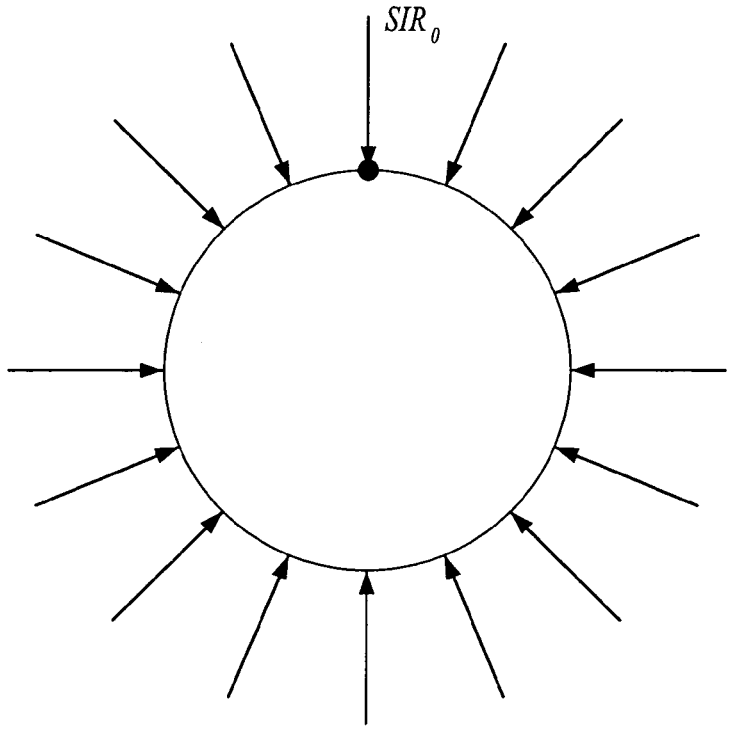
FIG. 7 is a diagram showing a filter for generating headphone signals in the three-dimensional audio signal processing system in accordance with an embodiment of the present invention.
Figure 8:
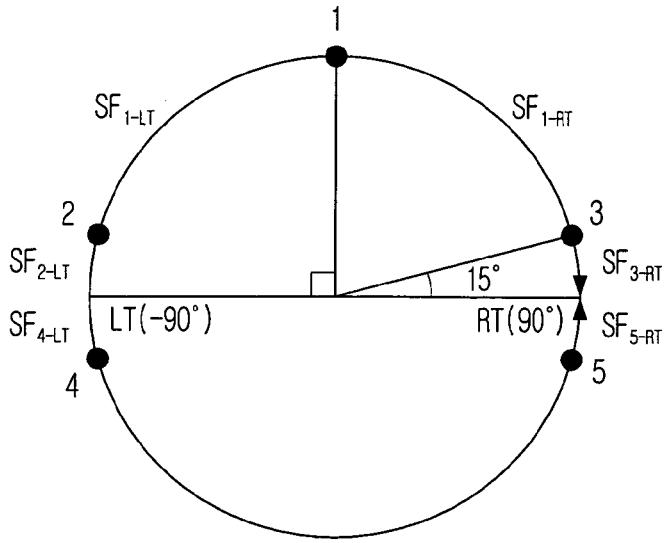
FIG. 8 is a diagram describing a headphone signal generating process in the three-dimensional audio signal processing system in accordance with an embodiment of the present invention.

FIG. 7 is a diagram showing a filter for generating headphone signals in the three-dimensional audio signal processing system in accordance with an embodiment of the present invention. FIG. 8 is a diagram describing a headphone signal generating process in the three-dimensional audio signal processing system in accordance with an embodiment of the present invention.

The impulse response of the rigid sphere is measured by setting up a mike at a horizontal 0° position of the rigid sphere and generating impulse by varying the direction of the speakers by 5° each time.

The headphone reproducing signals are generated based on a filter which is acquired by obtaining an inverse function of an impulse response at 0°, where a mike and a speaker are parallel with each other, among the measured impulse responses and performing impulse responses and convolution operation.

$$SF_{0\text{-}355}=\text{conv}(\text{SIR}_{0\text{-}355}, \text{SIR}_0^{-1}) \quad \text{Eq. 2}$$

where $\text{SIR}_0^{-1}$ denotes an inverse function of the impulse response at 0°; $\text{SIR}_{0\text{-}355}$ denotes impulse response of the rigid sphere at each angle; and "conv" denotes convolution operation.

The filter obtained as above and the output signals $u_1$, $u_2$, $u_3$, $u_4$, and $u_5$ of the three-dimensional audio signal acquiring unit 110 go through a convolution operation expressed as Equation 3 to thereby generate headphone reproducing signals.

$$v_L^{HP_B}=\text{conv}(u_1, SF_{1\text{-}LT})+\text{conv}(u_2, SF_{2\text{-}LT})+\text{conv}(u_4, SF_{4\text{-}LT}) \quad v_R^{HP_B}=\text{conv}(u_1, SF_{1\text{-}RT})+\text{conv}(u_3, SF_{3\text{-}RT})+\text{conv}(u_5, SF_{5\text{-}RT}) \quad \text{Eq. 3}$$

Figure 10A:
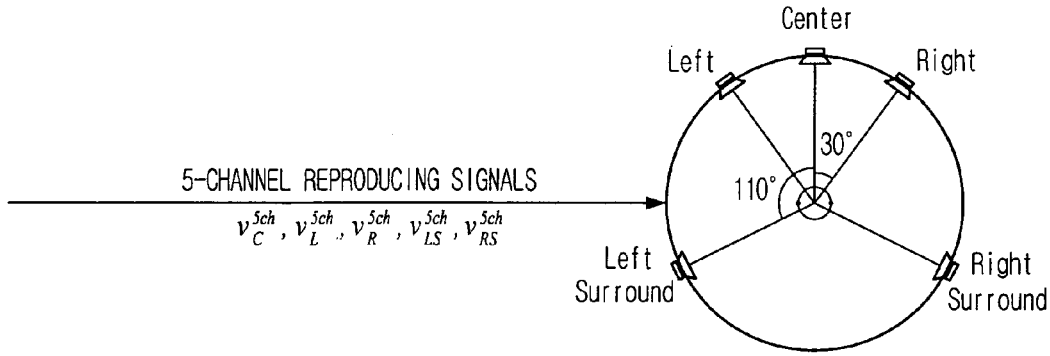
FIGS. 10A to 10E are diagrams describing a three-dimensional audio signal reproducing unit of the three-dimensional audio signal processing system in accordance with an embodiment of the present invention.
Figure 10B:
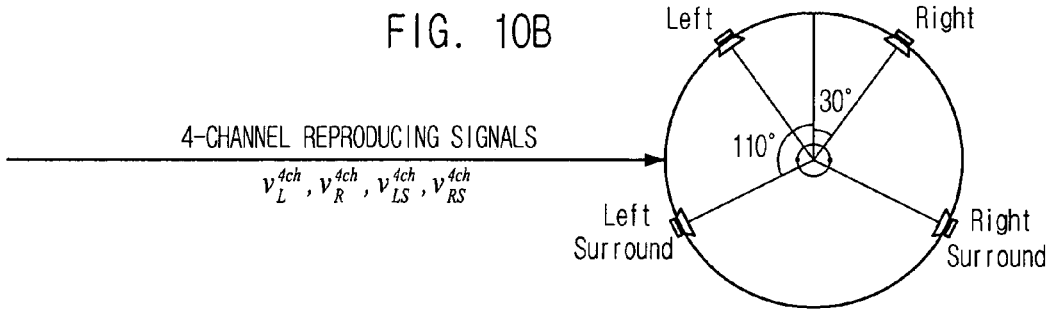
Figure 10C:
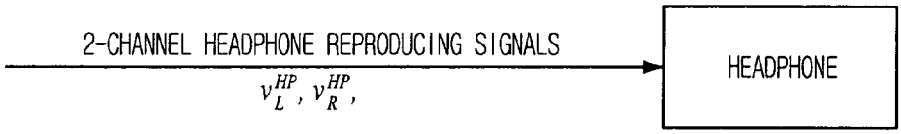
Figure 10D:
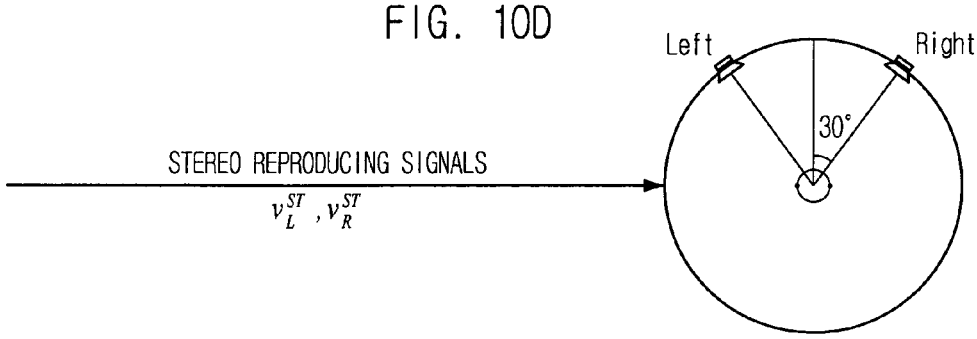

Meanwhile, to generate input signals $v_R^{ST}$ and $v_L^{ST}$ to the right and left speakers for stereo reproduction, crosstalk should be removed in a 2×2 inverse filter 350 based on transfer functions between the stereo speaker, which is shown in FIG. 10D, and the RT and LT at the right and left 90° of the rigid sphere.

Figure 9:
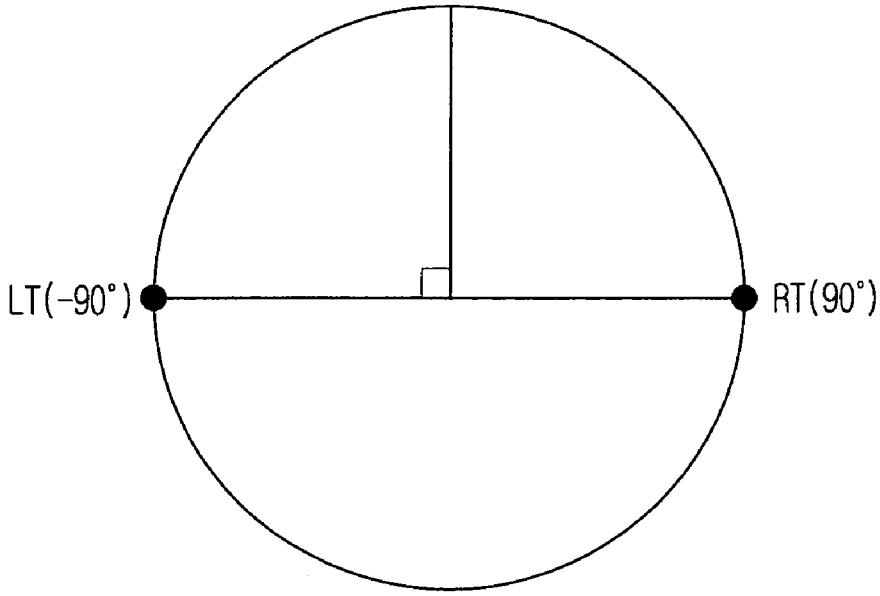
FIG. 9 is a diagram showing targets on a rigid sphere in the three-dimensional audio signal processing system when two channels are reproduced in accordance with an embodiment of the present invention.

FIG. 9 is a diagram showing targets on the rigid sphere in the three-dimensional audio signal processing system when two channels are reproduced in accordance with an embodiment of the present invention.

The impulse response between the stereo speaker and RT and LT of the rigid sphere is a value obtained by generating impulse in the right and left speakers of the stereo reproduction system, which is shown in FIG. 10D, and measuring the impulse at the RT and LT which are positions at the right and left 90° of the rigid sphere at the center.

The inverse function of the impulse response is the inverse filter that removes crosstalk between the stereo speaker and the target point (LT and RT) of the rigid sphere.

The input signals $v_R^{ST}$ and $v_L^{ST}$ to the right and left speakers of the stereo reproduction system are generated by selecting one of two-channel headphone reproducing signals A and B and performing convolution operation of a 2×2 inverse filter 350.

Figure 10E:
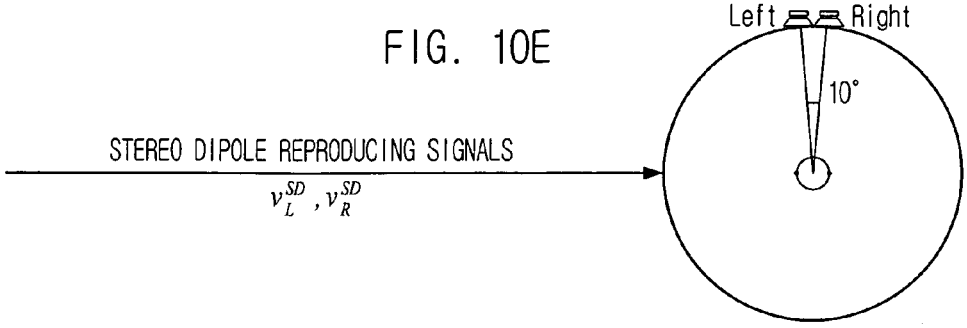

To generate input signals $v_R^{SD}$ and $v_L^{SD}$ to the right and left speakers for stereo dipole reproduction, crosstalk should be removed based on a transfer function between a stereo dipole reproduction system, which is shown in FIG. 10E, and the RT and LT at the right and left of the rigid sphere.

The impulse response between the speaker and the RT and LT of the rigid sphere at the center is a value obtained by generating impulse in the right and left speakers and measuring impulse at the RT and LT which are the right and left 90° positions of the rigid sphere in the stereo dipole reproduction system, which is shown in FIG. 10E.

The inverse function of the impulse response is the inverse filter that removes crosstalk between the stereo dipole speakers and the target point (LT and RT) of the rigid sphere.

Input signals $v_R^{SD}$ and $v_L^{SD}$ to the right and left speakers of the stereo dipole reproduction system are generated by selecting one of two-channel headphone reproducing signals A and B and performing convolution operation of the 2×2 inverse filter 360.

FIGS. 10A to 10E are diagrams describing a three-dimensional audio signal reproducing unit of the three-dimensional audio signal processing system in accordance with an embodiment of the present invention.

The three-dimensional audio signal reproducing unit 130 reproduces a signal obtained by performing conversion in the three-dimensional audio signal post-processing unit 120 through a conversion filter that is suitable for each reproduction environment.

Five-channel reproducing signals of the three-dimensional audio signal post-processing unit 120 are inputted to a five-channel reproduction system, which is shown in FIG. 10A, and four-channel reproducing signals are inputted to a four-channel reproduction system, which is shown in FIG. 10B.

Headphone reproducing signals A and B are input signals to a headphone, which is shown in FIG. 10C.

Stereo reproducing signals are input signals to a stereo reproduction system of FIG. 10D and stereo dipole reproducing signals are input signal to a stereo dipole reproduction system of FIG. 10E.

Figure 11:
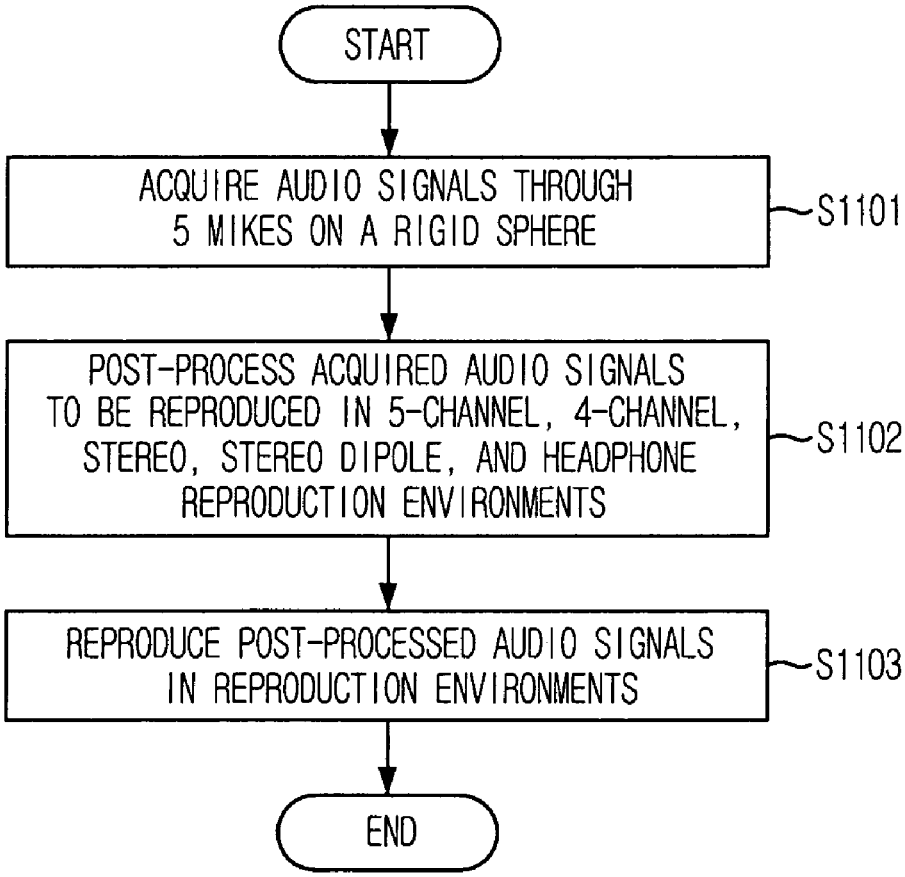
FIG. 11 is a flowchart describing a three-dimensional audio signal processing method in accordance with an embodiment of the present invention.

FIG. 11 is a flowchart describing a three-dimensional audio signal processing method in accordance with an embodiment of the present invention.

As shown, at step S1101, audio signals are acquired by using five mikes disposed on a rigid sphere. At step S1102, post-processing is performed on the acquired audio signals to reproduce them in diverse reproduction environments such as five-channel, four-channel, headphone, stereo, and stereo dipole reproduction environments.

Subsequently, at step S1103, audio signals obtained from the post-processing are reproduced in the actual reproduction environment.

The method described above can be embodied as a program and stored in a computer-readable recording medium such as CD-ROMs, RAM, ROM, floppy disks, hard disks, and magneto-optical disks.

The technology of the present invention can acquire three-dimensional audio signals by using five mikes on the rigid sphere and reproduce them in diverse reproduction environments such as five-channel, four-channel, headphone, stereo, and stereo dipole reproduction environments by performing post-processing. Since the rigid sphere with mikes makes people feel comfortable compared to a dummy head, it can be used to acquire three-dimensional audio signals in public places such as concerts.

While the present invention has been described with respect to certain preferred embodiments, it will be apparent to those skilled in the art that various changes and modifications may be made without departing from the scope of the invention as defined in the following claims.

What is claimed is:

1. A system for processing three-dimensional audio signals by using a rigid sphere, comprising: a three-dimensional audio signal acquiring means for acquiring three-dimensional audio signals by using a predetermined number of mikes set up on the rigid sphere, the three-dimensional audio signals being five-channel audio signals; and a three-dimensional audio signal post-processing means for converting the acquired three-dimensional audio signals to reproduce in diverse reproduction environments including five-channel, four-channel, headphone, stereo, and stereo dipole reproduction environments, wherein the three-dimensional audio signal post-processing means includes a 5×5 inverse filter to reproduce in the five-channel reproduction environment, a 4×4 inverse filter to reproduce in the four-channel reproduction environment, a 5×2 filter to reproduce in the headphone reproduction environment, and a 2×2 inverse filter to reproduce in the stereo and/or the stereo dipole reproduction environment; the mikes include a front mike for increasing the frontal sound image and two right side mikes and two left side mikes, the right side mikes being on the right side of the rigid sphere and the left side mikes being on the left side of the rigid sphere to compensate head movement of a human.

2. The system as recited in claim 1, wherein the three dimensional audio signal post-processing means performs:

5×5 crosstalk removal filtering using a 5×5 inverse filter for reproducing the three-dimensional audio signals by using five channels, the five channels not including a low frequency effect (LFE) channel in a 5.1 channel reproduction system, the 5×5 inverse filter generating five-channel reproducing signals;

4×4 crosstalk removal filtering using a 4×4 inverse filter for reproducing the three-dimensional audio signals through right and left speakers and right surround and left surround speakers by using four channels among the five channels, the four channels not including the center channel;

a conversion filtering for converting multichannel signals into two-channel signals to reproduce the multichannel signals in a headphone, the multichannel signals being either the three-dimensional audio signals or the five-channel reproducing signals; and 2×2 crosstalk removal filtering using a 2×2 inverse filter for reproducing the two-channel signals for the reproduction in the headphone in stereo and/or stereo dipole reproduction environments.

3. The system as recited in claim 2, wherein 5×5 inverse filtering is performed to generate the five-channel reproducing signals and a 5×5 inverse filter is obtained based on a transfer function from five-channel speakers to target points of the rigid sphere.

4. The system as recited in claim 2, wherein three-dimensional audio signals are acquired to generate four-channel reproducing signals by using the right and the left side mikes and not using the front mike among the mikes and a 4×4 inverse filter is obtained based on a transfer function from the four speakers to the target points of the rigid sphere for generating four-channel reproducing signals in the 4×4 crosstalk removal filtering.

5. The system as recited in claim 2, wherein the conversion filtering converts the multichannel signals into two-channel signals based on convolution between five channel speaker input signals obtained after passing through a 5×2 inverse filter for removing crosstalk and a transfer function from the speakers of the five-channel reproduction system to positions at a right 90° point from center of the rigid sphere and a left 90° point from center of the rigid sphere.

6. The system as recited in claim 2, wherein the conversion filtering generates two-channel signals for reproduction in a headphone by changing the output signals of five mikes to positions at a right 90° point from center of the rigid sphere and a left 90° point from center of the rigid sphere.

7. The system as recited in claim 2, wherein the 2×2 crosstalk removal filtering converts signals obtained by converting the three-dimensional audio signals for reproduction in the headphone based on a 2×2 inverse filter of a transfer function from stereo speakers to targets on the rigid sphere so as to generate two-channel reproducing signals for stereo reproduction; and the 2×2 crosstalk removal filtering converts signals obtained by converting the three-dimensional audio signals for reproduction in the headphone based on a 2×2 inverse filter of a transfer function from stereo dipole speakers to targets on the rigid sphere so as to generate two-channel reproducing signals for stereo dipole reproduction.

8. The system as recited in claim 1, further comprising:

a three-dimensional audio signal reproducing means for reproducing the audio signals obtained from the three-dimensional audio signal post-processing means in diverse reproduction environments including five-channel, four-channel, headphone, stereo, and stereo dipole reproduction environments.

9. A method for processing three-dimensional audio signals by using a rigid sphere, comprising the steps of:

a) acquiring three-dimensional audio signals by using a predetermined number of mikes set up on the rigid sphere, the three-dimensional audio signals being five-channel audio signals; and b) converting the three-dimensional audio signals to reproduce in diverse reproduction environments including five-channel, four-channel, headphone, stereo, and stereo dipole reproduction environments, wherein the converting includes reproducing in the five-channel reproduction environment using a 5×5 filter, reproducing in the four-channel reproduction environment using a 4×4 inverse filter, reproducing in the headphone reproduction environment using a 5×2 filter, and reproducing in the stereo and/or the stereo dipole reproduction environment using a 2×2 inverse filter; the mikes include a front mike for increasing the frontal sound image and two right side mikes and two left side mikes. the right side mikes being on the right side of the rigid sphere and the left side mikes being on the left side of the rigid sphere to compensate head movement of a human.

10. The method as recited in claim 9, wherein the step b) includes:

5×5 crosstalk removal filtering for reproducing the three-dimensional audio signals by using five channels, the five channels not including a low frequency effect (LFE) channel in a 5.1 channel reproduction system;

4×4 crosstalk removal filtering for reproducing the three-dimensional audio signals through fight and left speakers and right surround and left surround speakers by using four channels among the five channels, the four channels not including the center channel;

a conversion filtering for converting multichannel signals into two-channel signals to reproduce the multichannel signals in a headphone; and 2×2 crosstalk removal filtering for reproducing the two-channel signals for the reproduction in the headphone in stereo and/or stereo dipole reproduction environments.

11. The method as recited in claim 9, further comprising a step of:

c) reproducing the audio signals obtained from the three-dimensional audio signal post-processing means in diverse reproduction environments including five-channel, four-channel, headphone, stereo, and stereo dipole reproduction environments.

* * * * *